US011577874B2

(12) United States Patent
Wegge et al.

(10) Patent No.: US 11,577,874 B2
(45) Date of Patent: Feb. 14, 2023

(54) DEVICES, SYSTEMS AND METHODS FOR LABELING ITEMS IN A CONVEYOR LINE

(71) Applicant: Caljan A/S, Hasselager (DK)

(72) Inventors: Wieland Wegge, Beckum (DE); Thomas Fritz Heinz Heydolph, Munich (DE)

(73) Assignee: CALJAN A/S, Hasselager (DK)

( * ) Notice: Subject to any disclaimer, the term of this patent is extended or adjusted under 35 U.S.C. 154(b) by 44 days.

(21) Appl. No.: 16/980,711

(22) PCT Filed: Dec. 4, 2019

(86) PCT No.: PCT/EP2019/083667

§ 371 (c)(1),
(2) Date: Sep. 14, 2020

(87) PCT Pub. No.: WO2020/115126

PCT Pub. Date: Jun. 11, 2020

(65) Prior Publication Data

US 2021/0009300 A1 Jan. 14, 2021

Related U.S. Application Data

(60) Provisional application No. 62/775,678, filed on Dec. 5, 2018, provisional application No. 62/775,161, filed on Dec. 4, 2018.

(51) Int. Cl.
*B65C 1/02* (2006.01)
*B65C 9/36* (2006.01)
(Continued)

(52) U.S. Cl.
CPC ..... *B65C 1/021* (2013.01); *B65C 9/36* (2013.01); *B65C 9/44* (2013.01); *G09F 3/02* (2013.01);
(Continued)

(58) Field of Classification Search
CPC ..... F16D 2066/005; F16D 2121/24; F16D 2121/28; F16D 2125/40; F16D 2125/52;
(Continued)

(56) References Cited

U.S. PATENT DOCUMENTS

2012/0193022 A1 8/2012 Yamasita et al.
2016/0052659 A1* 2/2016 Bowers ..... B65C 1/021 156/64
(Continued)

FOREIGN PATENT DOCUMENTS

WO 2018088899 5/2018

OTHER PUBLICATIONS

Translation of WO-9323292-A1.*
(Continued)

*Primary Examiner* — Sonya M Sengupta
(74) *Attorney, Agent, or Firm* — Hanley, Flight & Zimmerman, LLC

(57) ABSTRACT

Devices, systems and methods for labeling an item in a conveyor line are disclosed. An example labeling station comprises a labeling member with a label holder configured to hold a label to be affixed to the item. The labeling member is configured to move at least the label holder at a matching speed of the conveyor in a matching direction and to affix the label to the item. An example labeling method includes obtaining a multi-dimensional representation of the item, determining a label target position in the representation, and controlling a labeling station to affix the label at the label target position on the item.

20 Claims, 10 Drawing Sheets

(51) Int. Cl.
*B65C 9/44* (2006.01)
*G09F 3/02* (2006.01)

(52) U.S. Cl.
CPC ..... *G09F 2003/0202* (2013.01); *G09F 2003/0272* (2013.01)

(58) Field of Classification Search
CPC ..... F16D 65/14; B65C 1/021; B65C 9/36; B65C 9/44; B65C 9/40; G09F 2003/0202; G09F 2003/0272; G09F 3/02
See application file for complete search history.

(56) References Cited

U.S. PATENT DOCUMENTS

2016/0063770 A1* 3/2016 Bowers ..... G07B 17/00508 156/64
2021/0009300 A1* 1/2021 Wegge ..... B65C 1/021

OTHER PUBLICATIONS

Translation of DE-4428242-A1.*
Translation of GB-2299412-A.*
International Searching Authority, "International Search Report," issued in connection with International Patent Application No. PCT/EP2019/083667, dated Mar. 19, 2020, 5 pages.
International Searching Authority, "Written Opinion," issued in connection with International Patent Application No. PCT/EP2019/083667, dated Mar. 19, 2020, 9 pages.

* cited by examiner

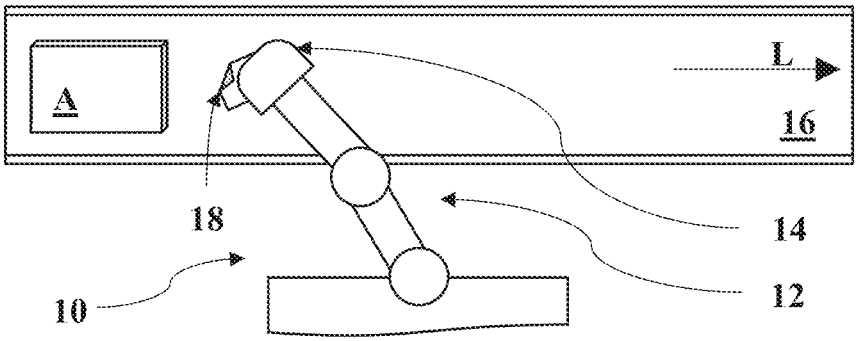
Fig. 3A
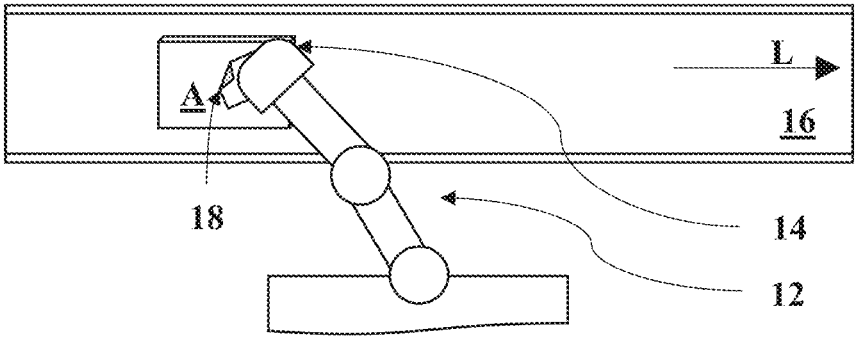
Fig. 3B
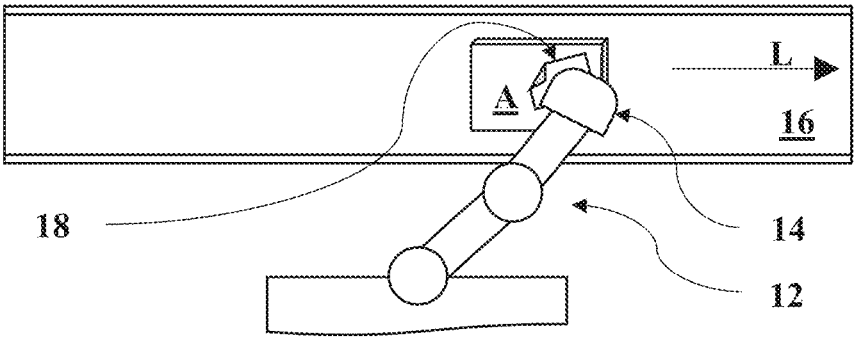
Fig. 3C
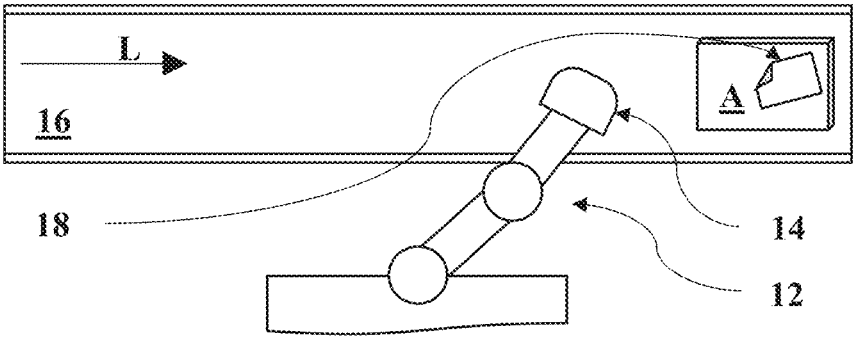
Fig. 3D
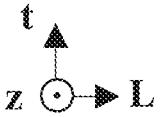

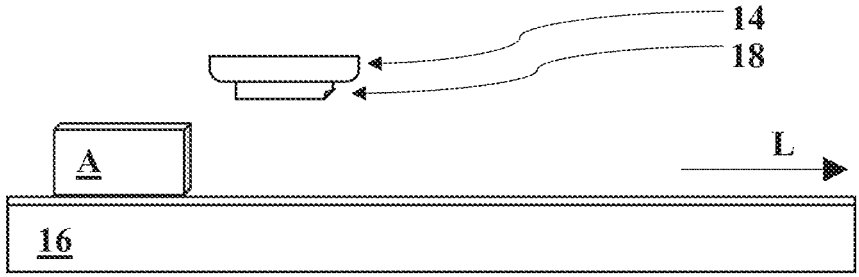
Fig. 4A
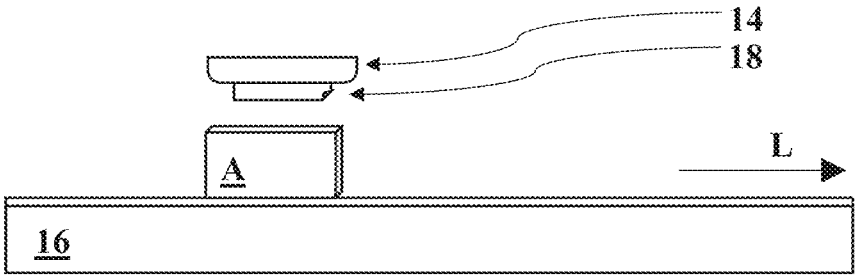
Fig. 4B
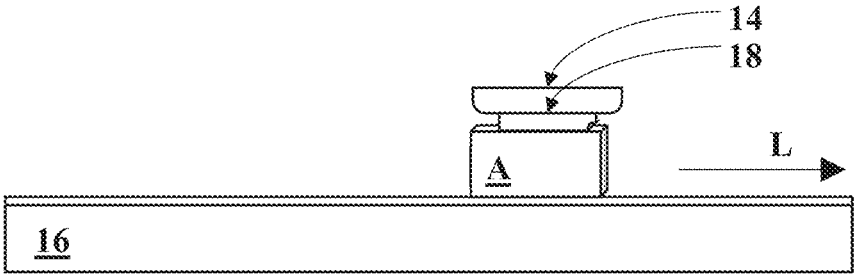
Fig. 4C
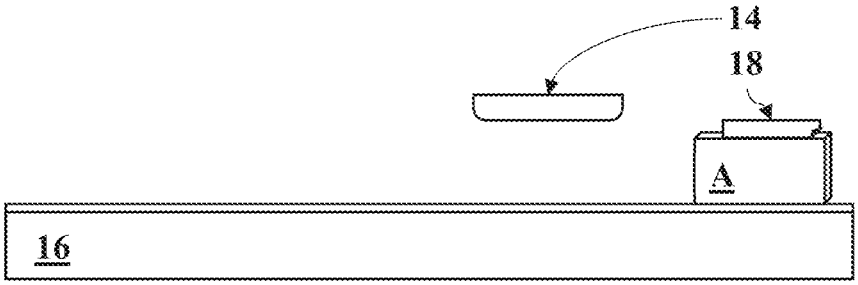
Fig. 4D
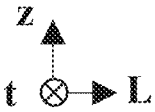

DEVICES, SYSTEMS AND METHODS FOR LABELING ITEMS IN A CONVEYOR LINE

FIELD OF THE DISCLOSURE

This disclosure relates generally to conveyors and, more particularly, to devices, systems, and methods for labeling items in a conveyor line.

BACKGROUND

Conveyor lines (e.g., for processing incoming or outgoing items in a warehouse), often affix labels to conveyed items. For instance, for incoming goods, a label displaying a unique identifier to enable identification of the item among all other items within the warehouse (an "internal" identifier) may be affixed to the item before storage or further processing in the warehouse. Similarly, for outgoing goods, a shipping label displaying a shipping address or a unique identifier of/for a delivery service to allow identification of a destination (e.g., an "external" identifier) of the item may be affixed to the item before the item leaves the warehouse.

SUMMARY

According to a first aspect, a labeling station for use at a conveyor line is provided, including: a labeling station for use in a conveyor line, the labeling station including a labeling member with a label holder configured to hold a label to be affixed to an item conveyed on the conveyor line in a conveying direction at a conveying speed. The labeling member is configured to move at least the label holder at a speed generally matching the first speed in a direction generally matching the first direction and to affix the label to the item.

According to a second aspect, a method for controlling a labeling station at a conveyor line is provided, the method including: obtaining a multi-dimensional representation of an item to be labeled and conveyed on the conveyor line; determining a label target position in the representation; and controlling the labeling station to affix the label at said label target position on the item.

According to a third aspect, a system for labeling items at a conveyor line is provided, including: an imaging station configured to obtain a multi-dimensional representation of the item; a labeling station configured to affix the label at a position on the item; and a control unit configured to determine said position to be used by the labeling station based on said representation.

BRIEF DESCRIPTION OF THE DRAWINGS

FIGS. 3A-3D are schematic top views illustrating an exemplary operation of the example labeling station of FIG. 2.

FIGS. 4A-4D are side views illustrating the exemplary operation according to FIG. 3.

DETAILED DESCRIPTION

Conveyors often need a reliable, fast and/or high-quality method for affixing of a label to the item. For instance, in some examples, there may be a need to affix a label to an item in a particular position (e.g. lower right-hand corner for shipping labels), over another label, or in a position clear of any other label or indicia on the item.

However, the wide variety of items and/or containers that can be used for packaging and shipping often impedes label affixing process(es). For instance, on the same conveyor line, there may be paper boxes, plastic boxes, polybags, shipping envelopes, and/or other container types, where each type can be in a variety of (e.g., different) sizes and/or shapes to be labeled, and have varying surface graphics/indicia placement/coverage.

In some instances, conventional approaches have used skewed conveyor belts in combination with side rails to align all solid, box-shaped containers (e.g., non-flexible or non-deformable boxes) on one side of the conveyor. Such approaches are typically less well-suited to handle the above-mentioned variety of container types. For instance, some containers (e.g., such as polybags) may be flexible and/or may be deformed and, thus, may be difficult to label after having been pressed against a side rail by use of conventional systems.

The examples disclosed herein may provide improved labeling of items moving on a conveyor, inter alia in terms of throughput, versatility, and/or quality. One aspect of the invention provides a labeling station for use in a conveyor line.

Figure 1:
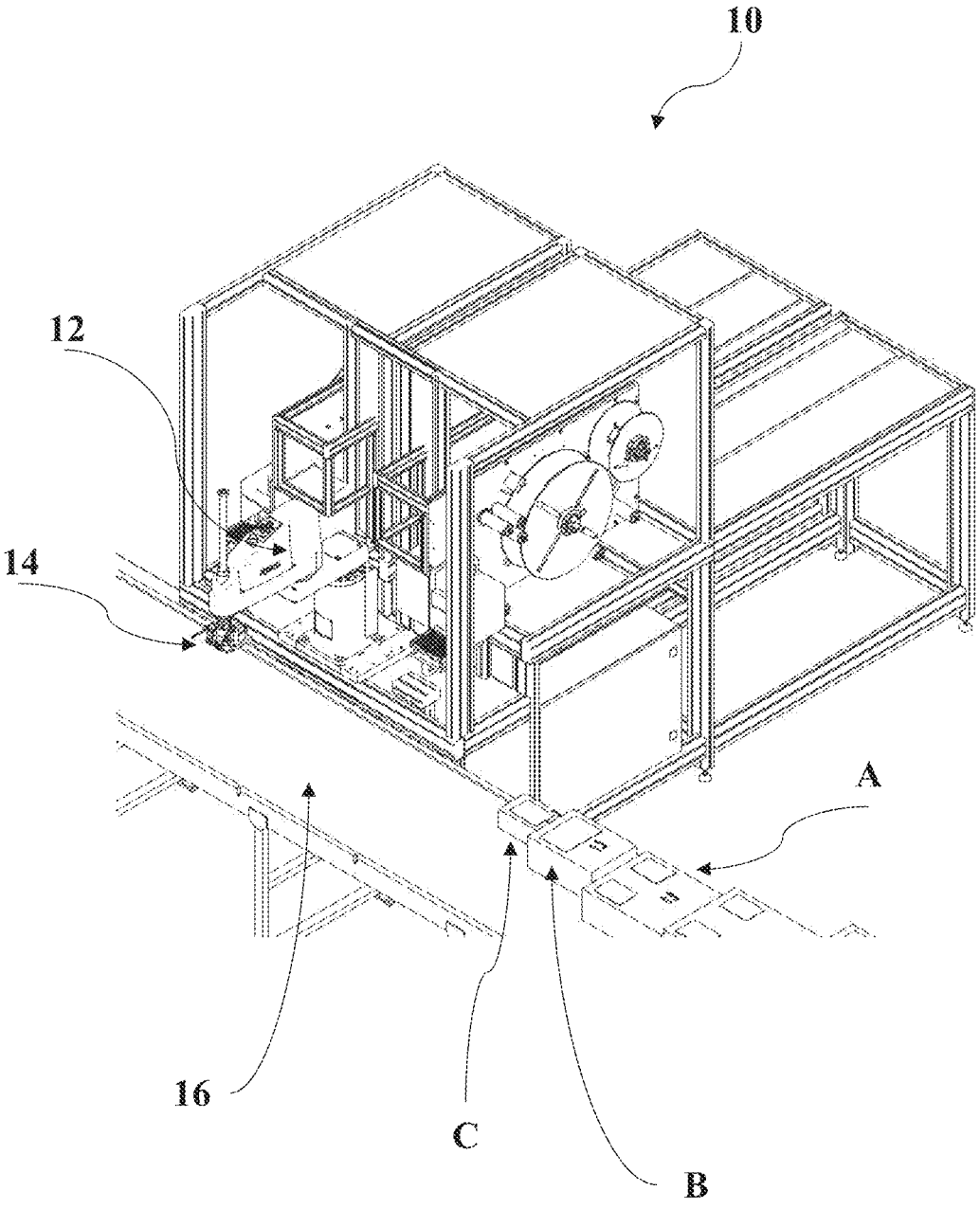
FIG. 1 is a perspective view of an example labeling station according to teachings disclosed herein.

FIG. 1 is a perspective view of a labeling station 10 in accordance with teachings disclosed herein. The labeling station 10 is arranged adjacent to a conveyor line. The conveyor line may include one or more conveyors 16. As used herein, the term "conveyor" covers a wide variety of conveying devices including, for example, conventional belt conveyors, powered roller conveyors, etc. Moreover, where there is reference to a "conveyor," it may also be a series of smaller modular conveyors.

In the example shown, multiple items A, B, C etc. are conveyed on a conveyor 16 from the lower right-hand corner of FIG. 1 towards the upper left-hand corner of FIG. 1. As used herein, the term "item" may include goods and/or containers, which are capable of receiving goods. For instance, in some examples, a label may be affixed directly to the good in question, to its original wrapping or to a shipping container (e.g., a box containing the goods or intended to contain the goods). In the example shown, the items are paper boxes of various (e.g., different) sizes.

As the items A, B, C are conveyed on the conveyor line, the labeling station 10 affixes a respective label to each one of the items A, B, C. The labeling station 10 includes a labeling member 12 with a label holder 14 configured to affix a respective label to each one of the items A, B, C. After the label is affixed, each of the items A, B, C continues on the conveyor line for further processing. For the purpose of illustration, further processing includes examples of outgoing-goods-processing (i.e. affixing a shipping label to a shipping container containing the goods to be shipped). As mentioned above, the presently disclosed teachings are not limited to outgoing-goods-processing and also include, for instance, processing of incoming goods. In any case, the particular order of the steps performed, or the presence of additional intermediate steps may depend on the particular use case.

Further, some aspects of the invention are illustrated for enhanced understanding using examples of particular items or containers (e.g., polybags). However, these aspects are not restricted to the particular type of item mentioned but are generally transferrable to other items, and in particular, to items with irregular shapes and/or flexible material(s).

Before proceeding with the detailed description of the drawings, further aspects are discussed.

A labeling station according to a first aspect is for use in a conveyor line to convey an item to be labeled in a first direction and at a first speed. Such labeling station includes a labeling member with a label holder configured to hold a label to be affixed to the item. The labeling member is configured to move at least the label holder at a speed generally matching the first speed in a direction generally matching the first direction and to affix the label to the item.

In some embodiments, the first direction may be a first degree of freedom of the labeling member and the labeling member may further be configured to move in at least one further or additional degree of freedom (e.g., a second degree of freedom) to affix the label to the item.

In particular, the additional degree of freedom to affix the label may include one or more of the following: translation along a transverse direction of the conveyor; translation along a vertical direction perpendicular to the conveyor (first direction and transverse direction); rotation around said first direction; rotation around a transverse direction of the conveyor; rotation around a vertical direction perpendicular to the conveyor (first direction and transverse direction); and/or a combination thereof.

In some embodiments, the labeling station may be configured to obtain a speed signal indicative of a first speed and/or an arrival signal (e.g., from a proximity sensor) indicative of an arrival of an item to be labeled.

In some embodiments, the label holder may be configured to affix the label using a contact-less application and/or using a contact-based application.

In some embodiments, the labeling station may further include one or more printing modules configured to print a label for the item and the labeling member may be configured to move the label holder to the one or more printing modules to pick up the printed label.

In some embodiments, the label holder and the item may be configured to be moved at the first speed over a first distance, where the first distance is predetermined or determined dynamically.

Figure 2:
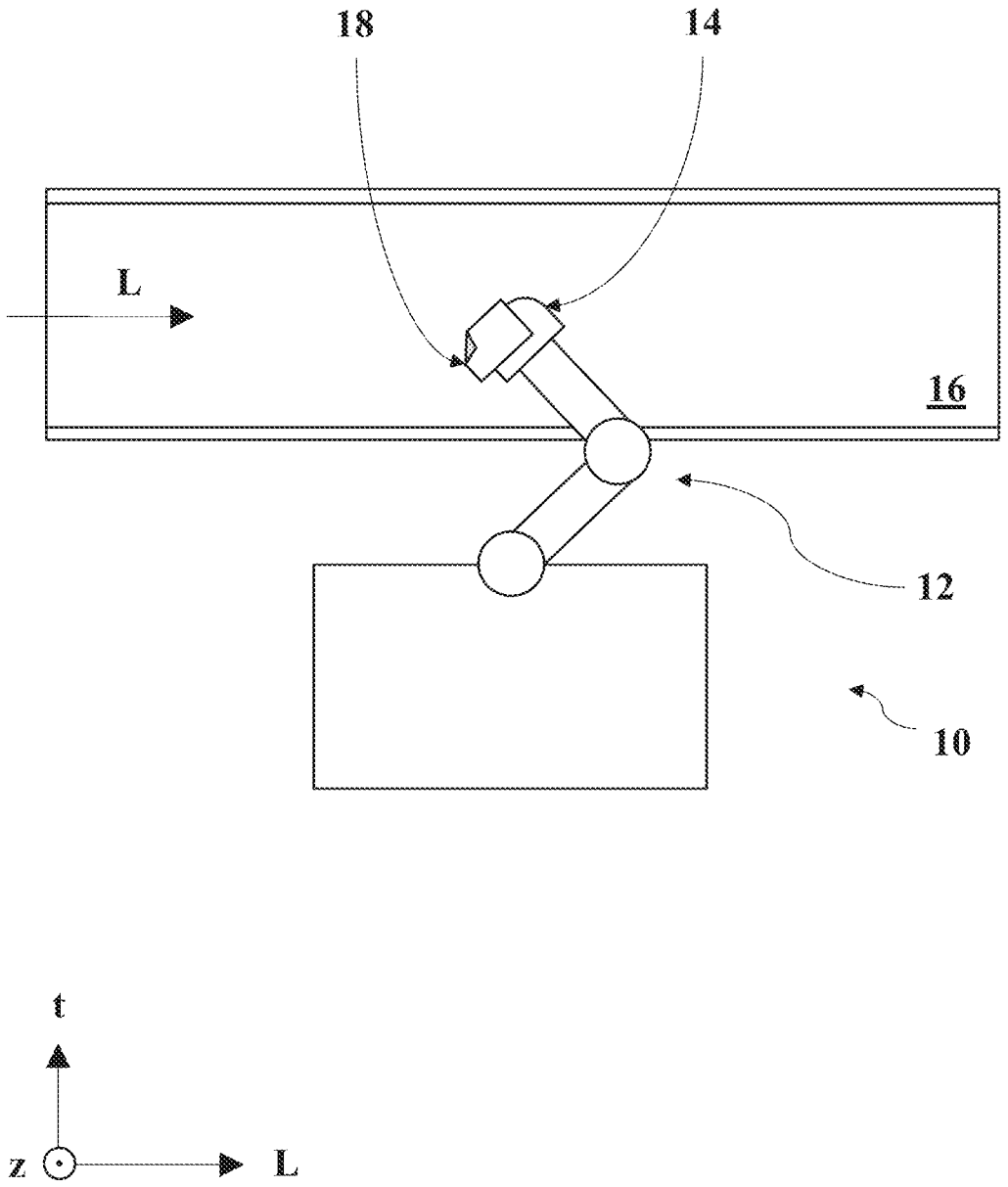
FIG. 2 is a schematic top view of an example labeling station disclosed herein.

FIG. 2 is a schematic top view of an example labeling station 10, similar to the labeling station of FIG. 1. The labeling station 10 includes an example labeling member 12. The labeling member 12 of the illustrated example is a robotic arm. The robotic arm of the illustrated example can move in at least one (e.g., a first) degree of freedom. In some examples, the robotic arm can move in two, three, four, five, six or more degrees of freedom. For instance, the robot arm of the illustrated example can be a selective compliance assembly robot arm (SCARA) or other types of pick-and-place robot(s), such as a delta robot. Other types of labeling members include one or more of the following: (translational and/or rotational) stages; (linear and/or rotary) motors.

The labeling member 12 includes an example label holder 14. In the example shown, the label holder 14 is arranged at an extremity of the labeling member 12 and holds a label 18. The labeling member is arranged at the labeling station such that at least the label holder 14 is or can be positioned over an example conveyor 16. The conveyor 16 is operable to convey items to be labeled in a first direction L (i.e., a longitudinal direction L) of the conveyor 16.

The at least one degree of freedom of the labeling member 12 includes the longitudinal direction L. This allows the label holder 14 to move along longitudinal direction L, a direction matching the direction (i.e., a matching direction) in which items are conveyed by the conveyor 16. In particular, such degree of freedom allows the label holder 14 to move at a same or near same speed (i.e., a matching speed) as a speed of the conveyor 16 and, thus, at the same or near same speed (i.e., a matching speed) as the item to be labeled.

In the context of the examples disclosed herein, a matching speed may be a speed that is within (e.g.,+/−) a percentage of the speed of the conveyed item (or the conveyor), and a matching direction may be a direction that is within (e.g., +/−) a delta angle from the direction of the conveyed item (or conveyor). In some examples, a matching speed and matching direction is the same speed and direction of the conveyed item (e.g., an identical speed and direction). In some examples, a matching speed and matching direction is (e.g., +/−) a percentage of the conveyed item speed and/or (e.g., +/−) a delta angle from the conveyed item direction. In some examples, a matching speed is not more than: (e.g., +/−) 1%, 2%, 3%, 5%, 7%, 10%, 15%, 20%, etc. of the conveyed item speed. In some examples, a matching direction is not more than: (e.g., +/−) 1°, 2°, 3°, 5°, 7°, 10°, 15°, 20°, etc. of the conveyed item direction.

Operating or moving the label holder 14 and the item to be labeled at a relative velocity of zero or near zero and at a relative angle of zero or near zero improves fast and reliable affixing of the label 18. In particular, operating or moving the label holder 14 at the same speed or near same speed as a speed of an item on the conveyor 16 (i.e., matching speed) and in the same direction or near same direction as the item on the conveyor 16 (i.e., matching direction) allows for a smooth affixing of the label to any item surface such as, for example, flexible polybag surfaces. This allows the label to be affixed to the item without causing the label to crumple, fold (e.g., onto itself), tear, and/or otherwise become damaged. This also prevents the label holder 14 from causing damage to the item or its packaging.

The additional degrees of freedom of the labeling member 12 include one or more of the following:

A translation along a vertical direction z, which is perpendicular to the longitudinal direction L and perpendicular to the plane defined by the surface of the conveyor 16; a translation along a transverse direction t, which is perpendicular to the longitudinal direction L and perpendicular to the vertical direction z, (i.e. in plane with or parallel to the surface of the conveyor 16); a rotation around the vertical direction z (also termed "skew angle" or "yaw angle"); a rotation around the longitudinal direction L (also termed "roll angle"); a rotation around the transverse direction t (also termed "pitch angle"); and/or any combination thereof. In particular, the labeling member 12 can include one, two, or three translational degrees of freedom and/or one, two, or three rotational degrees of freedom.

A degree of freedom of the labeling member 12 in the transverse direction allows positioning of the label holder 14 at a variety of transverse positions. Such configuration allows a more flexible choice of affixing position of the label on the item, as will be described in further detail below.

A degree of freedom of the labeling member 12 in the vertical direction allows positioning of the label holder 14 at a variety of vertical positions. Such configuration allows accommodation of a wide variety of item sizes (e.g., in particular item heights). Further, such configuration allows the label holder 14 to approach a surface of an item to be labeled. In particular, the degree of freedom in the vertical direction may be carried out nearly simultaneously to the above-described movement in longitudinal direction. As used herein, nearly simultaneously includes movement in two or more degrees of freedom that occur at the same instance or a movement in two or more degrees of freedom that occur within a few milliseconds (e.g., within between approximately 10 milliseconds and 100 milliseconds). This allows for a smooth and rapid affixture of the label, in particular for items with a flexible surface such as, for example, polybags. In other instances, the vertical approach may be made prior to or following the longitudinal movement, or a combination of both. In some examples, a pattern or movement of the labeling member 12 and/or the label holder 14 can be in one or more degrees of freedom and/or directions to affix the label 18 to an item. In some examples, the labeling member 12 and/or the label holder 14 can move synchronously or asynchronously in multiple directions or degrees of freedom.

In some use cases, there may be a need to affix a label in a particular orientation (e.g., with the label edges generally parallel to edges of the item or parallel to existing labeling or marking on the item). Such affixture orientation may be chosen to enhance or improve recognition to scanning or imaging systems in later processing stages/operations. A rotational degree of freedom of the labeling member 14 around the vertical axis allows affixture of the label in a skewed angle. Thus, the label may be affixed to an item in a particular orientation, even if the item's orientation is not aligned with the longitudinal direction.

Similar advantages exist for a rotational degree of freedom of the labeling member 14 around the transverse axis and/or the longitudinal axis. Such degree(s) of freedom allow for accommodation of a wide variety of item shapes (e.g., containers whose upper surface is not fully parallel to the surface of the conveyor). For instance, a polybag may present an arched (e.g., a convexly or concavely arched) upper/labeling surface. Although an apex or a base of an arched surface may be generally parallel to the surface of the conveyor, the edge or corner portions may not be parallel to this surface. In order to reliably affix a label to a particular edge or corner portion, the station may control the angle of the label holder and, thus, the angle of the label around the transverse axis and/or the longitudinal axis.

The above-mentioned designations of axes are used hereinafter for illustrating the spatial arrangement and movement of components.

In the example shown, the labeling member 12 is a robot arm anchored at one side of the conveyor 16 and movable (e.g., reaching) over (e.g., above) the conveyor 16. In other examples, other labeling members may be used. For instance, a bridge-type labeling member with a linear motor may be used, the labeling member being anchored at both sides of the conveyor 16.

In the example shown, the labeling member 12 includes two visible joints or hinges. However, depending on the construction and the number of degrees of freedom, a variety of suited mechanical arrangements provide an arm with the required or desired degree(s) of freedom.

Further, the label holder 14 is depicted as being arranged at an extremity of the labeling member 12. However, in other cases, the label holder 14 may be arranged at another position on the labeling member 12 and/or may be movably coupled to the labeling member 12.

FIGS. 3A-3D are top views illustrating an exemplary operation of the labeling station 10 of FIG. 2. FIGS. 4A-4D are side views illustrating the exemplary operation of the labeling station 10 of FIG. 2. In FIGS. 3A-3D and FIGS. 4A-4D, a succession of four exemplary states are depicted from FIG. 3A to FIG. 3D and from FIG. 4A to FIG. 4D, respectively.

In FIGS. 3A and 4A, an initial state is depicted. In the initial state, the labeling holder 14 provides (e.g., holds) a label 18 at a first position. In the example shown, the initial position of the labeling member 12 is an upstream position allowing for ample movement of the labeling member 12 in downstream longitudinal direction L.

In the initial state, an item A to be labeled is conveyed on the conveyor 16 at a given speed (e.g., an inch per second) in the first direction (L). In the example shown, the speed of the conveyor 16 is constant. In other examples, the speed of the conveyor 16 may vary or fluctuate (e.g., one inch per second and two inches per second) as the item A moves between a first portion of the conveyor 16 and a second portion of the conveyor 16 downstream from the first portion.

In FIGS. 3B and 4B, a subsequent state is depicted, where the item A has reached a vicinity of the label holder 14 at an intercept position of the labeling member 12 and will continue to be conveyed by the conveyor 16 in the first direction (L). Irrespective of whether the label holder 14 was previously moving or not, the state depicted in FIGS. 3B and 4B (intercept position) marks a beginning of a phase of moving the label holder 14 at the same speed as the conveyor 16 (and consequently, item A) in the first direction (L), such that label holder 14 and item A remain in mutual vicinity. For example, the label holder 14 matches (e.g., substantially matches within 1 percent) a speed of the item A and/or a speed of the conveyor 16. The labeling station 10 is controlled (e.g., via a controller) to initiate movement of the label holder 14 in the first direction (L) based on a signal indicating arrival of an item to be labeled. Such signal may be indicated by an additional unit (e.g. an imaging station located upstream of the labeling station 10) or it may be generated by the labeling station 10 itself (e.g. by one or more cameras/sensors attached to the label holder 14, the labeling member 12, etc., which detect arrival of an item (e.g., the item A)).

The conveyor 16 or a control unit of the conveyor 16 is communicatively coupled to the labeling station 10 and/or to a control unit of the labeling station 10. In such cases, the labeling station 10 (e.g., or its control unit) may obtain a signal indicative of the speed of the conveyor 16, such that movement of the label holder 14 can be controlled to match or occur at nearly the same speed as the conveyor 16 (i.e., matching speed) in the same or nearly the same direction (i.e., matching direction). In other instances, the labeling member 12 or a control unit communicatively coupled to the labeling member 12 determines the speed of the conveyor 16 (e.g., by optically tracking movement of the conveyor 16 or movement of an item on the conveyor). In any case, the labeling member 12 is configured to move at least the labeling member 12 and/or the label holder 14 at the matching speed in the matching direction.

In FIGS. 3C and 4C, a subsequent state is depicted, wherein both the item A and the label holder 14 have traveled a certain distance in the longitudinal direction L at the same speed, remaining in close mutual vicinity to a release position of the labeling member 12. This tracking distance may be predetermined or, alternatively, the distance may be determined dynamically. The tracking distance may be expressed in unit of length or it may be expressed in a unit of time (i.e., corresponding to a given duration), which may be converted into a unit of distance by means of a detected or measured speed of the conveyor 16 and/or the item A. A predetermined tracking distance or duration may be determined such that the distance travelled by the label holder 14 (e.g., back and forth from a release position to an intercept position) can be accomplished within the duration defined by the spacing of items (e.g., item A and another item such as item B of FIG. 1) on the conveyor 16 and the conveyor speed approaching the labeling station 10. A dynamic determination of tracking distance or duration may involve, for instance, obtaining information about current conveyor speed and/or gap spacing between subsequent items approaching the labeling station 10 in order to dynamically adjust movement of the label holder 14. The state depicted in FIGS. 3C and 4C (release position) marks the end of a phase of moving the label holder 14 at the same speed as the conveyor 16 (and consequently, item A) in the first direction, such that label holder 14 and the item A no longer remain in mutual vicinity.

Between the intercept state and the release state, the labeling member 12 moves the label holder 14 along at least the longitudinal degree of freedom in a first direction (longitudinal direction L), constituting the tracking movement. Additionally, the labeling member 12 may simultaneously move the label holder 14 along at least one additional degree of freedom in a second direction toward or into the path of the item in order to affix the label 18 to the item, constituting adjusting or labeling movement. The direction and extent (distance, duration, etc.) of labeling movement may depend on the size/shape of the item, the label application site on the item, and/or the relative position of the label holder 14 with respect to the item while between the intercept state and the release state.

In the present example, the labeling member 12 additionally simultaneously moves the label holder 14 in a vertical direction (i.e., downward (direction −z) in the orientation of the illustrated example) to approach (e.g., a surface of) the item A for affixing the label 18, as shown in FIG. 4C. Moving the label holder 14 in a vertical (z) direction to approach the item A can improve reliable affixture of the label 18 to the item A even when the item is directly below the label holder.

In some cases, affixing the label 18 to the item A may occur with or without mechanical or direct (e.g., physical) contact between the label holder 14 and the item A. For instance, affixing the label 18 to the item A may be carried out using a pneumatic-pressure-based system. In such examples, the labeling member 12 includes or is connected to a pneumatic unit (not shown). The pneumatic unit exercises or applies a negative pressure (e.g., a suction or vacuum) to pick up and hold the label 18 and exercises or applies a positive pressure (e.g., blows air) to deploy and affix the label 18 to the item A. In some examples, the label 18 includes adhesive to facilitate attachment and maintenance of the label 18 to/on the item A. Such examples may be carried out without mechanical/physical contact between the label holder 14 and the item A.

Additionally or alternatively, affixing the label 18 to the item A may occur using a mechanical-pressure-based method. In such cases, the label holder 14 is moved (e.g., vertically) towards the item A in a labeling movement at least until the label 18 carried by the label holder 14 comes into mechanical or direct (e.g., physical) contact with the item A. Mechanical pressure is exerted on the label 18 and the item A such that an adhesive sticks the label 18 onto the item A. This pressure may be applied by the label holder 18, another part of the labeling member 12, or station 10, for example. Upon retraction of the label holder 14, the label 18 is affixed to the item A.

FIGS. 3D and 4D depict a final state following the release state in which the label holder 14 has stopped moving in the first direction (longitudinal direction L) at the same speed as the item A, while the item A has continued to be conveyed on the conveyor 16 in the first direction. Item A continues to be conveyed for further processing (e.g., for shipping to a destination identified by the affixed label 18). In some instances, the label holder 14 may be moved (simultaneously) into another position (e.g. the initial position depicted in FIGS. 3A and 4A) via a reset movement, to repeat the above-described operation for affixing a label to a subsequent item (e.g., item B of FIG. 1) approaching the labeling station 10. In other words, between the release state (pertaining to the item A) and the intercept state (pertaining to the item B), the labeling member 12 moves the label holder 14 along at least the longitudinal degree of freedom in a direction opposite the first direction (longitudinal direction L), constituting a reset movement.

Additionally, the labeling member 12 may simultaneously move the label holder 14 along at least one additional degree of freedom in a third direction in order to prepare for the tracking and labeling of the item B, constituting a preparing movement. In the illustrated example, the label holder 14 may move upwards in vertical direction (z) in the orientation of FIG. 4D away from the item A and the conveyor 16. In some examples, the preparing movement may include movement toward an output region of a stationary printing module to pick up a label, and further include movement from the output region of a stationary printing module toward the next item to be labeled. The direction and extent (distance, duration, etc.) of preparing movement may depend on the size/shape of the items A and B, the label application site on the items A and B, the relative position of the output region of a printing module with respect to the label holder 14 at the release state (pertaining to the item A) and the intercept state (pertaining to the item B), and/or the relative position of the label holder 14 with respect to the item B while between the release state (pertaining to the item A) and the intercept state (pertaining to the item B). A preparing movement may also anticipate the intercept state illustrated in FIGS. 3A and 4A—in that circumstance, the direction and extent (distance, duration, etc.) of preparing movement may depend on the size/shape of the item A, the label application site on the item A, and/or the relative position of the label holder 14 with respect to the item A preceding the intercept state.

In another example labeling process including the steps discussed above, an additional movement can be made once the label has been affixed to the item A but before the release state. In such examples, the labeling member 12 may move the label holder 14 along at least one degree of freedom in a fourth direction away from or out of the path of the item A, constituting a retracting movement. In some examples, the third direction may be opposite the second direction of the labeling movement. The direction and extent (distance, duration, etc.) of retracting movement may depend on the size/shape of the item A, the label application site on the item A, and/or the relative position of the label holder 14 with respect to the item A at the time of the movement.

Figure 5:
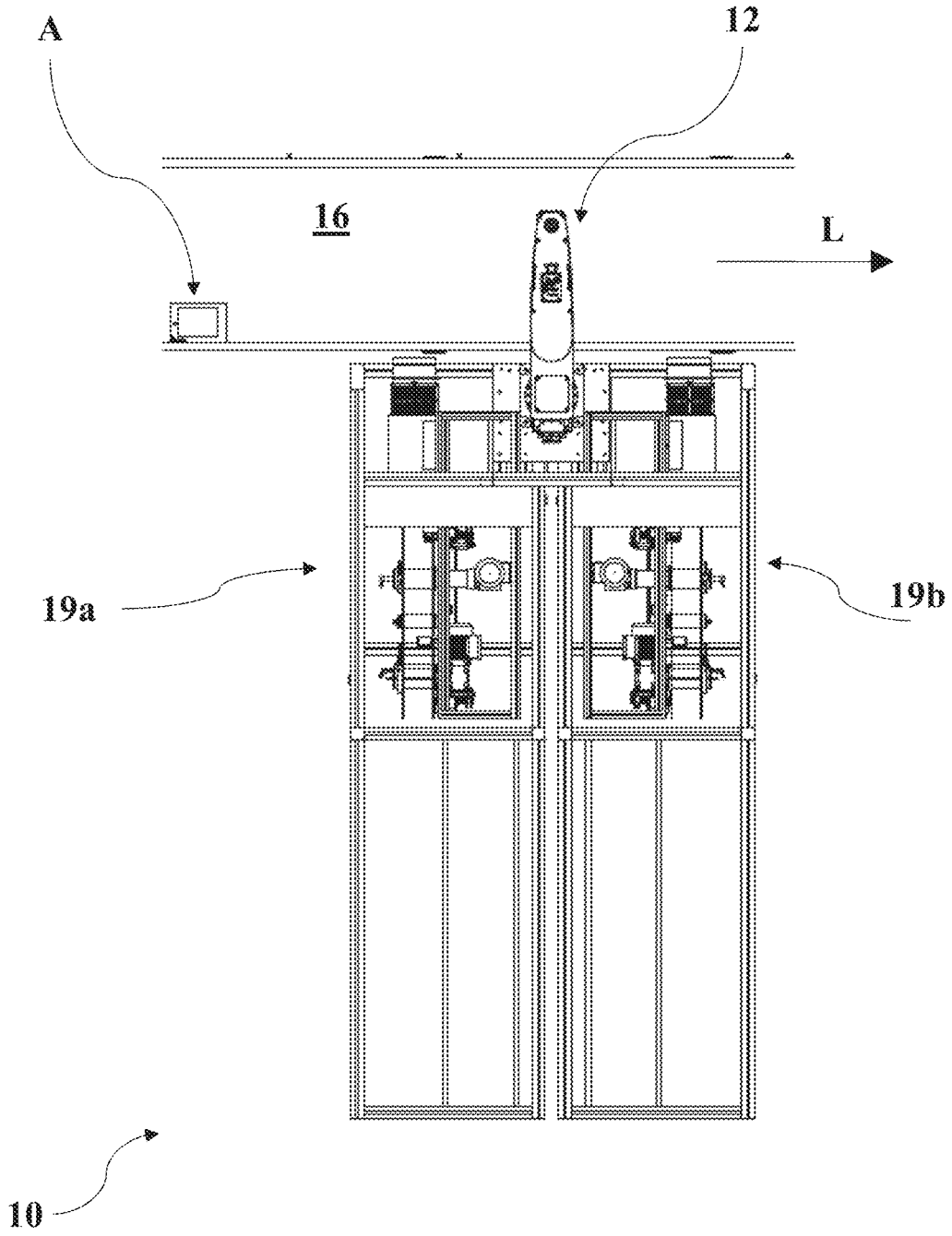
FIG. 5 is a top view of the example labeling station from FIG. 1 but having two printing modules.

FIG. 5 is a top view of the labeling 10 station from FIG. 1. Labeling station 10 includes labeling member 12 with a label holder (not shown), similar to the arrangement described above with reference to FIGS. 2, 3A-3D, and 4A-4D. In addition, the labeling station 10 includes a printing module 19*a*. The printing module 19*a* is configured to print labels to be affixed to items on the conveyor 16. Upon completion of the printing of the label, the printed label is positioned at an output region of the printing module 19*a*. The labeling member 12 is configured to move the label holder 14 towards the output region of the printing module 19*a* and to pick up the printed label.

In some instances, the label may be placed at the output region such that the label holder 14 picks up the printed label with the printed side of the label facing the label holder 14. For instance, if the output region is a traypositioned generally parallel to the conveyor, the label may extend in a longitudinal and in a transverse direction, with the printed side of the label pointing vertically upwards (+z direction). The other side of the label (i.e., the non-printed side), may be covered with an adhesive configured to affix the label to an item. The output region of the printing module 19*a* is typically configured to not adhere to the adhesive of the label, (e.g., by suitable surface treatment).

The labeling station 10 with printing module 19*a* presents an effective arrangement of components for reliable labeling of items.

In the example shown in FIG. 5, the labeling station 10 includes a further printing module 19*b*, which may be identical to or nearly identical to the printing module 19*a*. Printing module 19*b* is arranged next to printing module 19*a*. The label holder 14 is configured to move to the output region of either printing module 19*a*, 19*b*. The redundancy of the two printing modules 19*a*, 19*b*allows for a non-stop operation of the labeling station 10, even if one of the printing modules 19*a*, 19*b* presents a failure, needs to undergo maintenance work or replacement, and/or requires refill of consumables (e.g. ink, paper, etc.) needed to print the label(s).

In the example shown in FIG. 5 (similar to FIG. 1), each of the printing modules 19*a*, 19*b* may be pulled away from the conveyor 16 onto a table on the opposite side of the labeling station 10 (e.g., opposite to the conveyor 16) to facilitate access to the printing modules 19*a*, 19*b*, (e.g., for maintenance work or refilling of consumables).

Figure 6:
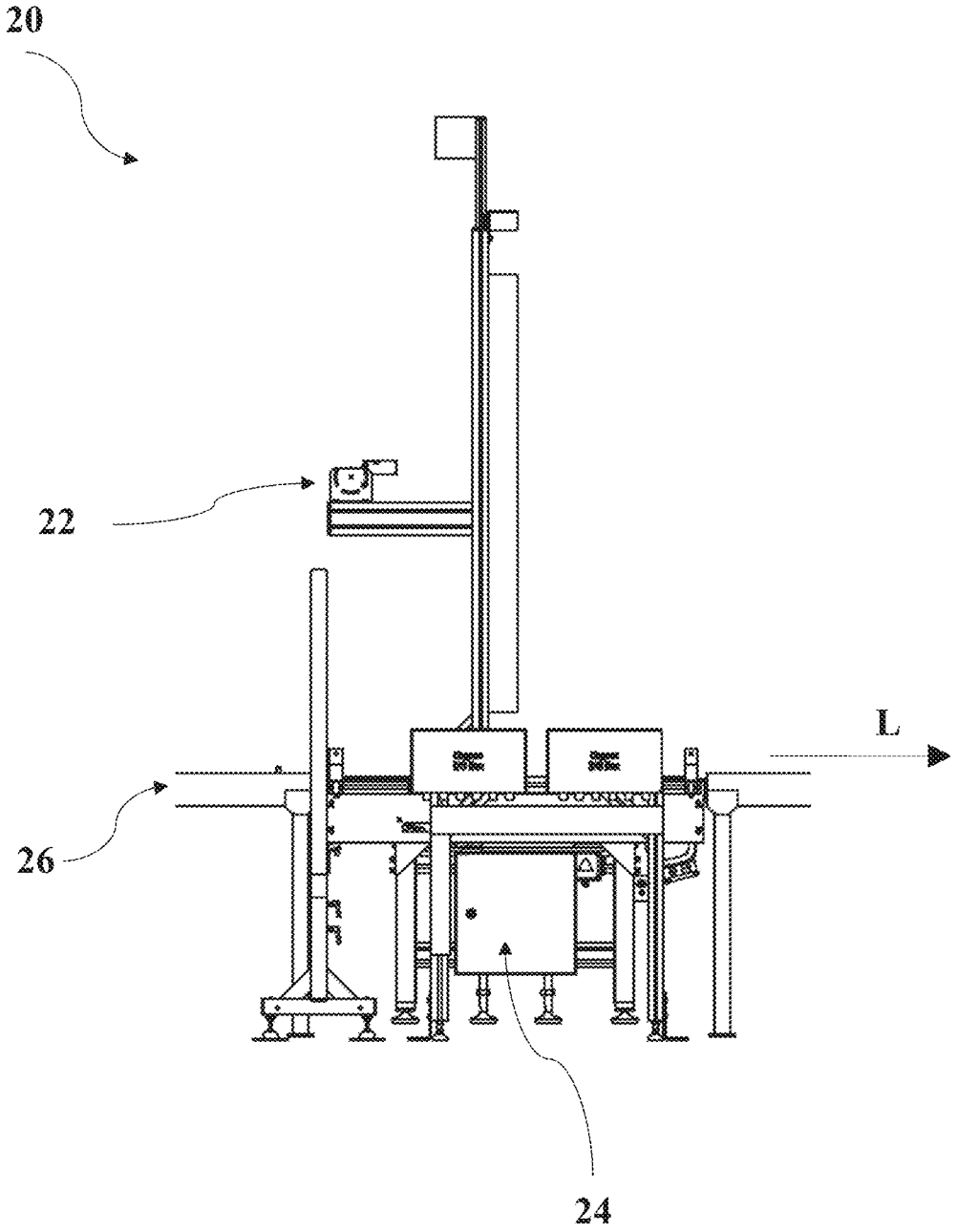
FIG. 6 is a side view of an example imaging station disclosed herein.

Another aspect of the invention provides a method for controlling a labeling station in a conveyor line. FIG. 6 is a side view of an imaging station 20, as viewed along the transverse direction of a conveyor 26. In the example shown, the conveyor 26 is configured to move items from the left-hand side of FIG. 6 towards the right-hand side of FIG. 6, along a longitudinal direction L.

Before proceeding with a detailed description of FIG. 6, further aspects are discussed. A labeling method according to this aspect of the invention is intended for implementation by a conveyor line operable to convey an item to be labeled. The method includes obtaining a multi-dimensional representation of the item; determining a label target position in the representation; and controlling the labeling station to affix the label at said label target position on the item.

In some embodiments, the multi-dimensional representation of the item may represent the item as a function of at least a longitudinal direction of the conveyor and a transverse direction of the conveyor.

In some embodiments, the representation of the item may be indicative of at least one of the following: an orientation of the item, physical boundaries of the item, dimensioning of the item, weight of the item, surface properties of the item, optical/visible/aesthetic properties of the item, etc.

In some embodiments, the determining may include determining at least one of the following: a spatial target position for the label and a rotation of the label with respect to the exterior surface of the item.

Returning to FIG. 6, the imaging station 20 includes one or more sensors/cameras, configured to acquire a multi-dimensional representation of an item to be conveyed on the conveyor 26. In the example of FIG. 6, a single sensor 22 is visible. However, additional sensors may be arranged for instance in a line along the transverse direction. Thus, the additional sensors are not visible in the orientation shown in FIG. 6 as they appear concealed behind the visible sensor 22).

In other examples, the sensors can be arranged in other patterns or locations. For example, sensors may be arranged in a line along the longitudinal direction, in a line along the transverse direction, and/or a combination of the preceding.

The sensors may include, but are not limited to, one or more of the following: optical sensors (e.g. laser sensors, infrared sensors, one or more light grids), imaging sensors, acoustic sensors, inductive sensors, capacitive sensors and/or another other sensor(s) such as still and video cameras.

In any case, the sensors are arranged to not only acquire a single-dimensional representation (such as a height profile along one axis), but to acquire a multi-dimensional (i.e. at least two-dimensional, three-dimensional, etc.) representation of an item being conveyed on the conveyor 26.

For instance, a multi-dimensional representation of the item may be acquired, which is indicative of the height h(x,y) of the item as a function of two spatial variables x,y (the height being represented by a certain height above the conveyor 26). In particular, the height of the item may be expressed as a function of positions (x,y) along the longitudinal and transverse axes of the conveyor 26.

Such an exemplary multi-dimensional representation (e.g., height h as a function of longitudinal and transverse position) may be acquired, for instance, by methods of triangulation using the sensors 22 of the imaging station. Multiple sensors 22 arranged in a line along the transverse direction may be configured to acquire multiple height values along the transverse direction quasi-simultaneously. By repeating the acquisition in a sequence of time points as the item is conveyed through or beneath the imaging station, such multiple values may be acquired for each one of the sequence of time points, corresponding to multiple positions along the longitudinal dimension of the item.

Multiple sensors may acquire a multi-dimensional representation, for instance, using triangulation methods of image processing, point cloud calculation methods and/or shadow projection (e.g. using light grids) and/or any other method(s).

In any case, the multi-dimensional representation may be in any suitable data format, such as a multi-dimensional table, a vector-type data format, etc. The data content to be transferred to a labeling station or a control unit thereof may include coordinates for the label to be applied. In addition, one or more angles for the label to be applied may be provided by the data content. Data content may be transferred via standard protocols such as, for example, TCP/IP and/or ProfiNet. Communication may occur via established ethernet or fieldbus standards, such as ProfiBus.

The multi-dimensional representation of the item may be used to control the spatial movement of a labeling member 12 or label holder 14 of a labeling station arranged downstream of the imaging station 20 along the conveyor 26. In particular, the label holder 14 may be controlled such that the affixture of the label 18 occurs at a target position on the item determined on the basis of the multi-dimensional representation. Alternatively, or in addition, the multi-dimensional representation of the item may be used to control the size and/or shape of the label to be applied to the item.

As a non-limiting example, the above-described two-dimensional height information may be used to determine regions of variable exterior surface deformation of the item. For instance, a polybag may be creased or otherwise deformed in one region (e.g. at the leading edge), whereas it may be relatively flat in another region (e.g. at the trailing edge). Based on this information, the labeling station may be controlled to affix the label in the flat region (i.e. at the trailing edge). This capability can ensure optimal or at least preferable (i.e., more reliable, etc.) affixture of the label such that it facilitates (faster, more accurate, reliable, etc.) downstream processing.

In some instances, the conveyor 16 may be devoid of side rails, at least between the imaging station and the labeling station. Such an arrangement may prevent the item from being deformed or displaced on its way from the imaging station to the labeling station, which would lead to a discrepancy between the acquired representation of the item and the actual state of the item as it reaches the downstream labeling station 10.

The present invention is not restricted to the before-mentioned, two-dimensional representation of the height of an item to determine optimal label positions on the item. Further exemplary uses will be described, e.g. with reference to FIG. 8.

Figure 7A:
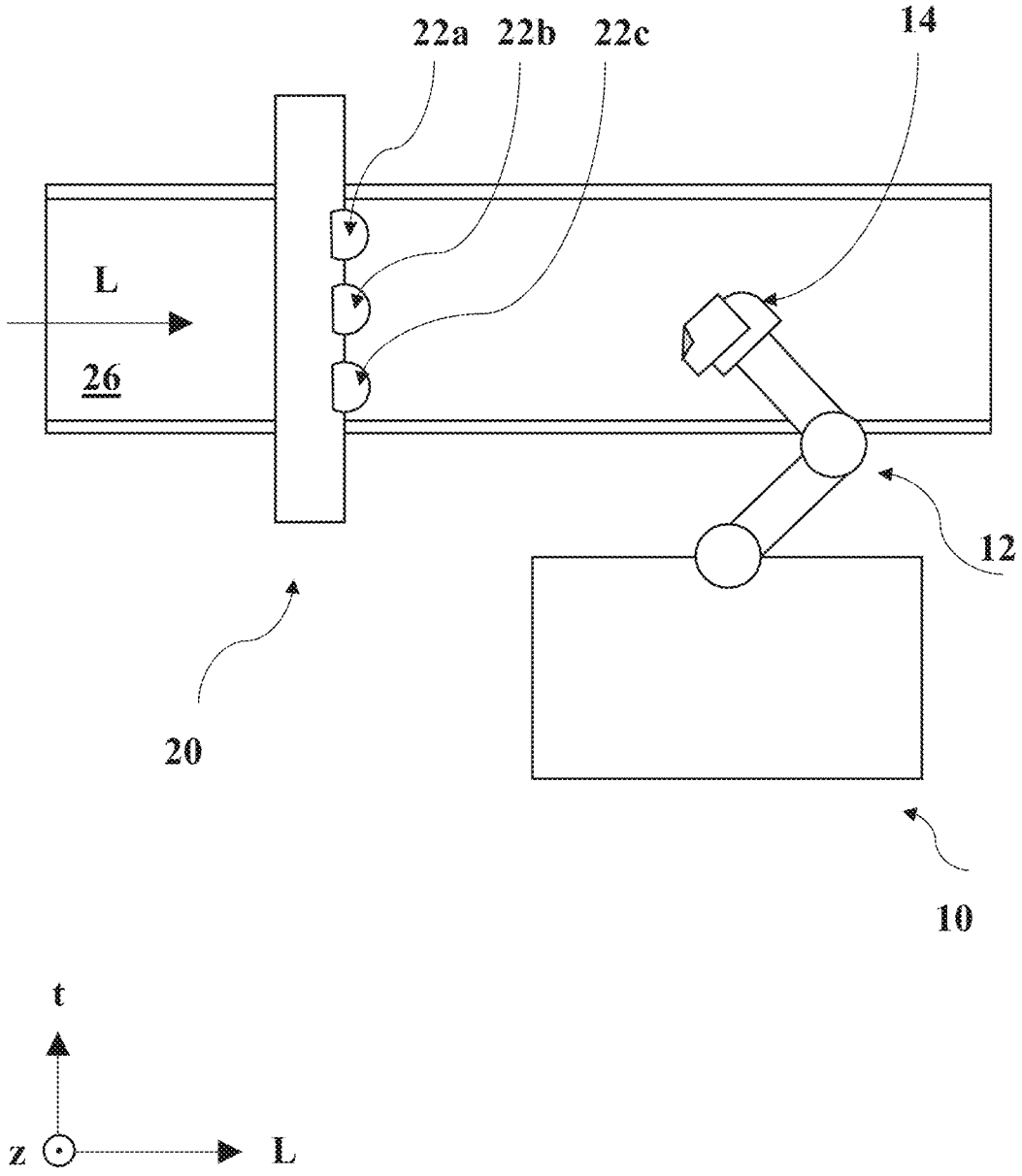
FIG. 7A is a schematic top view of an example imaging station disclosed herein.

FIG. 7A is a schematic top view of an example imaging station 20, similar to the imaging station shown in FIG. 6. The imaging station 20 includes a series of sensors 22*a,b,c* (e.g., three sensors) arranged in a line along the transverse direction t. As mentioned, the presently disclosed teaching may be practiced with various numbers of sensors, such as at least two, at least three, at least five, at least ten, at least twenty, at least 100 sensors, etc. The sensors 22*a,b,c* may be arranged such that the full width of a conveyor 26 may be imaged. In the examples shown, the sensors 22*a,b,c* are rigidly attached to a bridge structure spanning the conveyor 26 and anchored on both sides of the conveyor 26. In other examples, the sensors may be mobile and may be controlled to move (e.g. in the transverse direction) during acquisition of the representation, and the sensors 22*a,b,c* may be mounted on a structure not connected to the conveyor 26. In addition, FIG. 7A shows a downstream labeling station 10, similar to the labeling station of FIG. 2, including a labeling member 12 with a label holder 14.

Figure 7B:
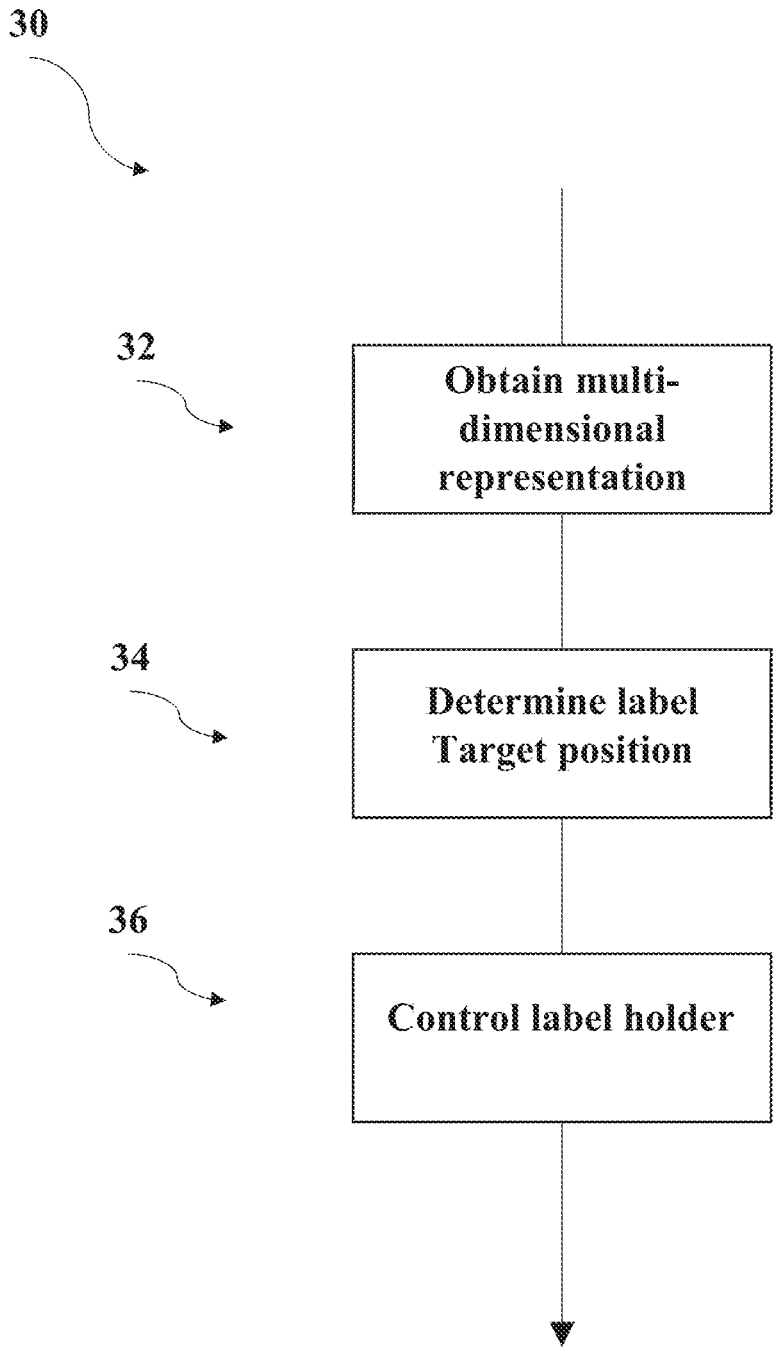
FIG. 7B is an example flowchart representative of an example labeling method disclosed herein.

FIG. 7B is a high-level flowchart of an exemplary labeling method 30. The method 30 includes a sequence of steps 32, 34, 36. In a step 32, a multi-dimensional representation of an item (e.g., item A of FIG. 1) to be labeled is obtained. In a step 34, a label target position, location, and/or size is determined in the obtained representation. In a step 36, a label holder (e.g., label holder 14) is spatially controlled to affix a label (e.g., label 18) onto the item in accordance with the determined target position.

Figure 8:
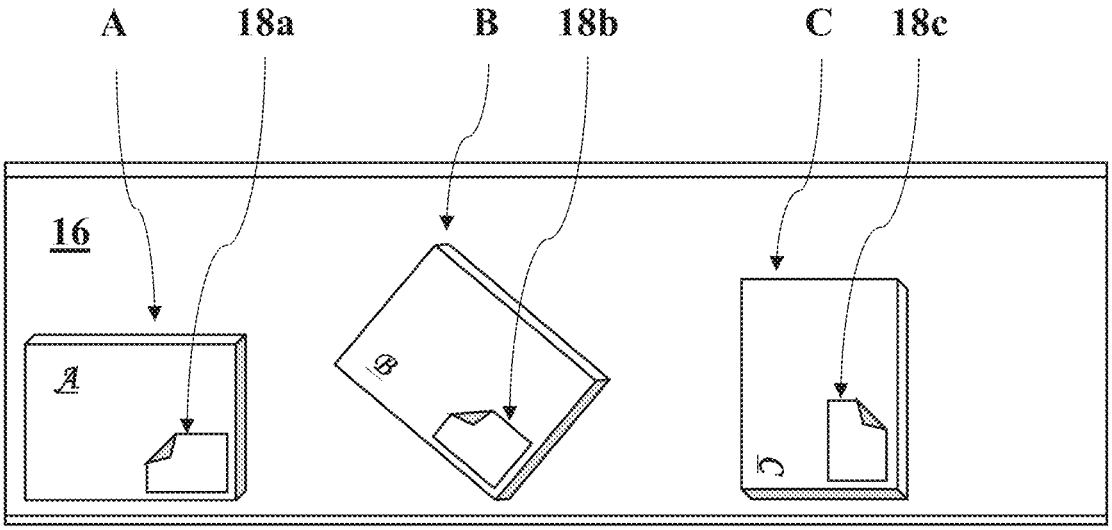
FIG. 8 is a schematic top view of multiple example items on an example conveyor line disclosed herein.
Figure 8:
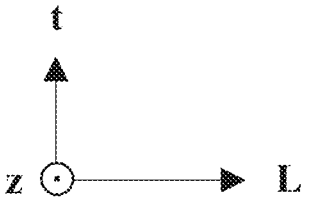

FIG. 8 is a schematic top view of multiple items A, B, C on a conveyor line 16. The items A, B, C to be labeled with respective labels 18*a-c* differ in a variety of ways.

For instance, as shown in the schematic top view, although the items A, B, C are similar in length and width (dimensions in the t×L plane), they differ in their respective position and dimension along the longitudinal axis L, dimension along axis t, and orientation around axis z. Item A is aligned with the longitudinal axis L such that its length is oriented along the longitudinal axis L of the conveyor 16. For item C, however, the length is oriented along the transverse axis t (i.e., perpendicular to the longitudinal axis L of the conveyor 16). Item B presents an intermediate orientation, with the length at a certain angle (e.g., a non-parallel and/or non-perpendicular angle) with respect to the longitudinal axis L of the conveyor 16 (i.e., rotated around axis z less than 90 degrees).

According to a particular use case of affixing a rectangular label to rectangular items (e.g., as shown in FIG. 8), there may be a need to affix the label such that the edges of the label are parallel to the edges of the item (as indicated by labels 18*a,b,c* in FIG. 8). The methods disclosed herein enable a multi-dimensional representation of the item to be obtained, a label target position, size, and/or shape to be determined, and the label to be affixed in accordance therewith. In the present example, the label target position determined based on the multi-dimensional representation is provided with a skew angle for the label (i.e. the label is to be affixed to the item only after having been rotated around the vertical, z axis) that corresponds to the skew angle of the item.

In another example, also shown in the schematic top view of FIG. 8, the items also differ in their appearance, in particular the presence of writing, logos, previously attached labels, or other indicia. In the example shown, each of the items A, B, C presents a single logo in one corner of the respective items A B C (e.g., upper case, underlined, italicized letter in a corner of the item). Depending on the use case, there may be a need to affix a label at a location clear of the items ABC, so that the label does not interfere with presentation of the logo or other information present on the item (as shown in FIG. 8). For instance, for items A and B, a label may be placed in the respective lower right-hand corner as the logos are present on the left-hand side only. In this manner, the label does not interfere with the logo of the left-hand side. For item C, however, an alternative target position can be identified since the lower right-hand corner (after correction for the orientation) was determined to be covered by a logo already. The upper right-hand corner can be chosen as an alternative.

In other use cases, there may be a need to cover a previously attached label (such as an internal label) in order to obtain a certain overall appearance (e.g., to avoid patchwork-type appearances, or the possibility for misreading the label). In any case, the presently disclosed method may be used to obtain a multi-dimensional representation of the item, to determine a label target position and to affix the label in accordance therewith.

To enable the functionality described above, the multi-dimensional representation may (additionally or alternatively to the height information) contain information about the optical/visible/aesthetic properties of the item. Optical properties include, but are not limited to, brightness information, color information, transparency information, reflectivity information, etc. The optical property information of the multi-dimensional representation may be used to determine a label target position (e.g. in a clear spot, as indicated by high brightness information, or in a premarked spot, as indicated by area of contrast from surrounding). The determined label position may then be used to affix the label to the item in accordance therewith.

Figure 9:
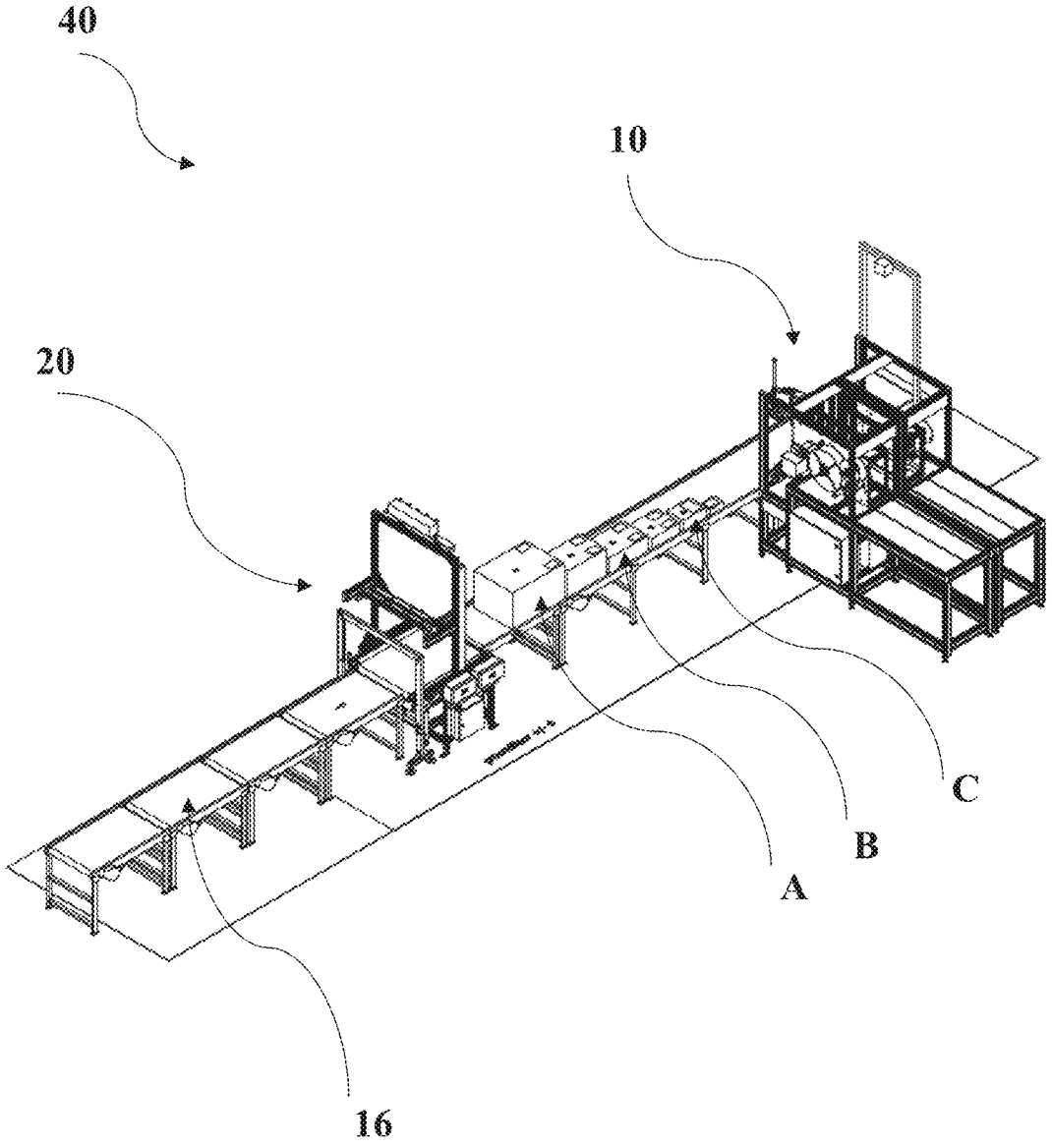
FIG. 9 is a perspective view of an example system disclosed herein.

In a further aspect of the invention, a system is provided for use in a conveyor line. FIG. 9 is a perspective view of an exemplary system 40 according to the teachings disclosed herein.

Before proceeding with a detailed description of FIG. 9, further aspects are discussed. The conveyor line is operable to convey an item to be labeled. The labeling system includes an imaging station, a labeling station and a control unit. The imaging station is configured to obtain at least one multi-dimensional representation of the item. The labeling station is configured to affix the label at a target position on the item. A control unit is configured to determine the target position to be labeled by the labeling station based on the representation and/or orientation of the item.

In some embodiments, the labeling station may be a labeling station according to the first aspect.

In some embodiments, the system further includes a conveyor unit adapted to form part of the conveyor line. In some embodiments, the control unit is further configured to control at least one speed of the conveyor line such that a spacing between successive items on the conveyor line is controlled.

Returning to FIG. 9, system 40 is for use along a conveyor 16 configured to convey items A, B, C. System 40 includes an imaging station 20 configured to obtain at least one multi-dimensional representation of the items. System 40 further includes a labeling station 10, configured to apply a label at a respective target position on each item. The system 40 includes a control unit (not shown), configured to determine the target position to be labeled by the labeling station 10 on the basis of the representation and/or orientation determined or obtained by the imaging station 20. The control unit is communicatively coupled to the imaging and labeling stations 20, 10.

In the example shown, the control unit (not shown) may further be adapted to control the spacing between successive items on the conveyor line. For instance, the conveyor may include multiple, independently driven and independently controlled conveyor units 16. By slowing down or halting an upstream conveyor unit, spacing of subsequent items relative to items on downstream conveyor units may be increased. Conversely, by accelerating an upstream conveyor unit (or by slowing down or halting the downstream conveyor unit), spacing of subsequent items relative to items on downstream conveyor units may be decreased.

An initial spacing between items may be determined by the imaging station 20. Based on this information, the control unit may control one or more of the conveyor units 16 in order to obtain a predetermined gap spacing, which may be optimized to provide a high throughput of items while at the same time allowing the labeling station to print and affix label to each item.

At least some of the aforementioned examples include one or more features and/or benefits including, but not limited to, the following:

In some examples, a labeling station for use at a conveyor line, the conveyor line operable to convey an item to be labeled in a conveying direction at a first speed includes a labeling member including a label holder configured to hold a label to be affixed to the item, the labeling member being configured to move at least the label holder at a matching speed in a matchingt direction and to affix the label to the item.

In some examples, the first direction is a first degree of freedom of the labeling member, and wherein the labeling member is configured to move in at least one further degree of freedom for affixing the label.

In some examples, the further degree of freedom for affixing the label includes one or more of the following: translation along a transverse direction of the conveyor; translation along a vertical direction perpendicular to the conveyor; rotation around said first direction; rotation around a transverse direction of the conveyor; rotation around a vertical direction perpendicular to the conveyor; a combination thereof.

In some examples, the labeling station is configured to obtain at least one of a speed signal indicative of the first speed or an arrival signal indicative of the arrival of an item to be labeled.

In some examples, the label holder is configured to affix the label using at least one of a contact-less application or a contact-based application.

In some examples, the labeling station includes one or more printing modules configured to print a label for the item, and wherein the labeling member is configured to move the label holder to the one or more printing modules to pick up the printed label.

In some examples, the label holder and the item are configured to move at the first speed over a first distance, wherein the first distance is predetermined or determined dynamically.

In some examples, a labeling method for controlling a labeling station at a conveyor line, the conveyor line operable to convey an item to be labeled, includes obtaining a multi-dimensional representation of the item; determining a label position in the representation; and controlling the labeling station to affix the label at said label position on the item.

In some examples, the multi-dimensional representation of the item represents the item as a function of at least a longitudinal direction of the conveyor and a transverse direction of the conveyor.

In some examples, the representation of the item is indicative of at least one of the following: an orientation of the item, physical boundaries of the item, dimensioning of the item, weight of the item, surface properties of the item, or optical properties of the item.

In some examples, the determining of the label position includes determining at least one of a spatial position for the label or a rotation of the label.

In some examples, a labeling system for use at a conveyor line, the conveyor line operable to convey an item to be labeled includes an imaging station configured to obtain a multi-dimensional representation of the item, a labeling station configured to affix the label at a position on the item, and a control unit configured to determine said position to be used by the labeling station based on said representation.

In some examples, a conveyor unit adapted to form part of the conveyor line.

In some examples, the control unit is configured to control at least one speed of the conveyor line to control a spacing between successive items on the conveyor line.

In some examples, the conveyor line is operable to convey the item to be labeled in a conveying direction at a conveying speed, and In some examples, the labeling station includes a labeling member with a label holder configured to hold a label to be affixed to the item, the labeling member configured to move at least the label holder at a matching speed in a matching direction and to affix the label to the item.

In some examples, said first direction is a first degree of freedom of the labeling member, and wherein the labeling member is configured to be moved in at least one further degree of freedom for affixing the label.

In some examples, the further degree of freedom for affixing the label includes one or more of the following: translation along a transverse direction of the conveyor; translation along a vertical direction perpendicular to the conveyor; rotation around said first direction; rotation around a transverse direction of the conveyor; rotation around a vertical direction perpendicular to the conveyor; a combination thereof.

In some examples, the labeling station is configured to obtain at least one of a speed signal indicative of the first speed or an arrival signal indicative of the arrival of an item to be labeled.

In some examples, the label holder is configured to affix the label using either a contact-less application or using a contact-based application.

In some examples, the labeling station includes one or more printing modules configured to print a label for the item, and wherein the labeling member is configured to move the label holder to the one or more printing modules to pick up the printed label.

In some examples, the label holder and the item are configured to be moved at the first speed over a first distance, wherein the first distance is either predetermined or determined dynamically.

Although certain example methods, apparatus and articles of manufacture have been disclosed herein, the scope of coverage of this patent is not limited thereto. On the contrary, this patent covers all methods, apparatus, and articles of manufacture fairly falling within the scope of the claims of this patent.

The invention claimed is:

1. A labeling station for use at a conveyor line, the conveyor line operable to convey an item to be labeled in a conveying direction at a conveying speed, the conveying direction being a longitudinal direction of the conveyor line, the labeling station comprising:

a labeling member including a label holder to hold a label to be affixed to the item, the label holder to move in a longitudinal direction with the item between a first lateral position and a second lateral position at substantially the conveying speed to affix the label to the item.

2. The labeling station according to claim 1, wherein the conveying direction is a first degree of freedom of the labeling member, and wherein the labeling member is to move in a second degree of freedom different from the first degree of freedom to affix the label to the item.

3. The labeling station according to claim 2, wherein the second degree of freedom includes one or more of: translation along a transverse direction of the conveyor; translation along a vertical direction perpendicular to the conveyor; rotation around the first direction; rotation around a transverse direction of the conveyor; rotation around a vertical direction perpendicular to the conveyor; a combination thereof.

4. The labeling station according to claim 1, wherein the labeling station determines at least one of a speed signal indicative of the conveying speed or an arrival signal indicative of the item to be labeled during operation of the labeling station.

5. The labeling station according to claim 1, wherein the label holder is to affix the label using at least one of a contact-less application or a contact-based application.

6. The labeling station according to claim 1, further including one or more printing modules to print a label for the item, and wherein the labeling member is to move the label holder to the one or more printing modules to pick up the printed label.

7. The labeling station according to claim 1, wherein the label holder is to move at the conveying speed and the item is to move at the conveying speed over a first distance, wherein the first distance is at least one of predetermined or determined dynamically.

8. A labeling method for controlling a labeling station at a conveyor line, the conveyor line operable to convey an item to be labeled in a conveying direction and at a conveying speed, the conveying direction being a longitudinal direction of the conveyor, the method comprising:

obtaining a multi-dimensional representation of the item;

determining a label target position in the representation; and moving a label holder of the labeling station in the longitudinal direction between a first lateral position and a second lateral position at substantially the conveying speed to affix a label carried by the label holder to the label target position on the item.

9. The method of claim 8, wherein the multi-dimensional representation includes at least the longitudinal direction of the conveyor and a transverse direction of the conveyor.

10. The method of claim 8, wherein the representation of the item is indicative of at least one of: an orientation of the item, physical boundaries of the item, dimensioning of the item, weight of the item, surface properties of the item, or optical properties of the item.

11. The method of claim 8, wherein the determining of the label target position includes determining at least one of a spatial position for the label or a rotation of the label.

12. A labeling system for use at a conveyor line, the conveyor line operable to convey an item to be labeled in a conveying direction at a conveying speed, the conveying direction being a longitudinal direction of the conveyor, the labeling system comprising:

an imaging station to obtain a multi-dimensional representation of the item;

a labeling station to affix the label at a target position on the item, the labeling station including a labeling member having a label holder structured to hold the label to be affixed to the item, the at least one of the labeling member or the label holder to move in the longitudinal direction between a first lateral position and a second lateral position at substantially the conveying speed to affix the label to the item; and a control unit to determine the target position to be used by the labeling station based on the representation.

13. The system of claim 12, further including a conveyor unit adapted to form part of the conveyor line.

14. The system of claim 12, wherein the control unit is to adjust the conveying speed of the conveyor line to control a spacing between successive items on the conveyor line.

15. The system of claim 12, wherein the conveying direction is a first degree of freedom of the labeling member, and wherein the labeling member is to move in at least a second degree of freedom different than the first degree of freedom to affix the label to the item.

16. The system of claim 15, wherein the second degree of freedom includes one or more of: translation along a transverse direction of the conveyor; translation along a vertical direction perpendicular to the conveyor; rotation around the first direction; rotation around a transverse direction of the conveyor; rotation around a vertical direction perpendicular to the conveyor; a combination thereof.

17. The system of claim 12, wherein the labeling station is to obtain at least one of a speed signal indicative of the conveying speed or an arrival signal indicative of an arrival of an item to be labeled.

18. The system of claim 12, wherein the label holder is to affix the label using either a contact-less application or using a contact-based application.

19. The system of claim 12, wherein the labeling station includes one or more printing modules to print a label for the item, and wherein the labeling member is to move the label holder to the one or more printing modules to pick up the printed label.

20. The system of claim 12, wherein the label holder is to move at the conveying speed and the conveyor is to move the item at the conveying speed over a first distance, wherein the first distance is either predetermined or determined dynamically.

* * * * *